US008748718B2

(12) United States Patent
Pederson

(10) Patent No.: US 8,748,718 B2
(45) Date of Patent: Jun. 10, 2014

(54) ADJUSTABLE SADDLE

(71) Applicant: Kevin L. Pederson, Forest City, IA (US)

(72) Inventor: Kevin L. Pederson, Forest City, IA (US)

( * ) Notice: Subject to any disclaimer, the term of this patent is extended or adjusted under 35 U.S.C. 154(b) by 0 days.

(21) Appl. No.: 13/852,169

(22) Filed: Mar. 28, 2013

(65) Prior Publication Data

US 2013/0255467 A1 Oct. 3, 2013

Related U.S. Application Data

(60) Provisional application No. 61/619,552, filed on Apr. 3, 2012.

(51) Int. Cl.
*G10D 3/04* (2006.01)

(52) U.S. Cl.
CPC ..... *G10D 3/04* (2013.01)
USPC ..... 84/298; 84/299

(58) Field of Classification Search
None
See application file for complete search history.

(56) References Cited

U.S. PATENT DOCUMENTS

| | | | | |
|---|---|---|---|---|
| 282,147 | A * | 7/1883 | Anderberg | 84/298 |
| 462,869 | A * | 11/1891 | Mendenhall et al. | 84/299 |
| 615,053 | A * | 11/1898 | Utt | 84/299 |
| 1,138,803 | A * | 5/1915 | Shutt | 84/298 |
| 2,029,135 | A * | 1/1936 | Harry et al. | 84/298 |
| 2,565,253 | A * | 8/1951 | Sebastiano | 84/298 |
| 4,911,055 | A * | 3/1990 | Cipriani | 84/299 |
| 5,227,571 | A * | 7/1993 | Cipriani | 84/307 |
| 5,265,513 | A * | 11/1993 | Smith | 84/298 |
| 5,347,905 | A * | 9/1994 | Cipriani | 84/298 |
| 6,133,515 | A * | 10/2000 | Hoshino | 84/307 |
| 6,369,305 | B1 * | 4/2002 | Powers et al. | 84/298 |
| 6,867,354 | B2 * | 3/2005 | Shimooka et al. | 84/312 R |
| 8,076,559 | B2 * | 12/2011 | Toone | 84/298 |
| 2002/0092404 | A1 * | 7/2002 | Naimish | 84/298 |
| 2005/0045018 | A1 * | 3/2005 | Turner | 84/298 |
| 2007/0095192 | A1 * | 5/2007 | Moore | 84/298 |
| 2010/0005944 | A1 * | 1/2010 | Eliasson et al. | 84/314 N |
| 2013/0255467 | A1 * | 10/2013 | Pederson | 84/298 |

* cited by examiner

*Primary Examiner* — Robert W Horn
(74) *Attorney, Agent, or Firm* — Zarley Law Firm, P.L.C.

(57) ABSTRACT

An adjustable saddle for a musical instrument having a base with a plurality of depressions. The depressions receive a plurality of support guides that are releasably and slidably connected to the base. The support guides have an upper front edge with a front slot and an upper rear edge with a rear slot.

3 Claims, 3 Drawing Sheets

ADJUSTABLE SADDLE

CROSS REFERENCE TO RELATED APPLICATION

This application claims the benefit of U.S. Provisional Application No. 61/619,552 filed Apr. 3, 2012.

BACKGROUND OF THE INVENTION

This invention is directed toward an adjustable saddle. More specifically, and without limitation, this invention is directed to an adjustable guitar saddle with variable engagement and adjustability with each guitar string to compensate for differing intonation points of strings having various gauges.

The majority of traditional acoustic guitars and other various stringed instruments such as a mandolin, banjo, fiddle, and cello include the main standard components of a neck with a fingerboard or fret board with multiple frets extending outward from a hollow body. A plurality of anywhere from four to twelve strings each extend longitudinally in parallel spaced relation from a first attachment from tuning knobs of a head stock at an upper end of the neck opposite the body, over a raised transverse nut between the headstock and the fret board, and downward to a second point of attachment to a bridge located on an upper surface of the body of the instrument. Specifically, with acoustic guitars and many of the aforementioned stringed instruments, proximate to the second attachment points on the body, each string extends over a raised, transverse saddle and thereafter extends downward at an angle from the suspension point provided by the saddle through to the second attachment point to the bridge, known as a "break angle". Thus, the strings are suspended in spaced relation in between and at a height determined by the saddle and the nut over the soundboard of the body and the frets of the neck, wherein the distance between the saddle and the nut is called the scale length of each string.

Furthermore, acoustic guitars and additional stringed instruments include strings having different gauges or weights/thicknesses that allow the instrument to produce a varied array of tones. As a result, each string vibrates with different characteristics defined by the differences in gauges, weights/thicknesses, and the resultant resilience or elasticity of the strings. When one or more of the strings are plucked, strummed, or otherwise caused to be engaged, the strings produce vibrations which travel through the saddle to the soundboard to produce the frequency or tone desired by the instrument's player. As a result, the position of the saddle is critical to proper intonation of each string. However, as each string is held down against a fret to produce a particular tone, the string is stretched such that the tuning of the string is caused to deviate or produce a sharp intonation. Furthermore, because each of the strings has different gauges, weights/thicknesses, and resiliencies or elasticity, the deviation of intonation (or intonation point) for each of the strings is different.

Additionally, the position of the saddle on the bridge as well as the downward pressure of each string on the saddle and resultant break angle has measurable effects on intonation. Improper placements and excessively high downward pressures can cause the saddle to be bowed, warped, bent forwardly or backwardly, and further can cause notches in the saddle under the strings, all of which alter the proper scale length of each string as well as the proper vibration of the string without any lateral "roll". Traditional saddles are plagued by the aforementioned problems because such saddles are characterized by a single strip of raised material which is fixedly attached to the bridge, and thus unable to compensate for intonation deviations due to differing string thicknesses. Additionally, many traditional saddles fail to properly distribute and/or compensate for string pressure and further fail to provide the proper break angle due, and thus suffer from the foregoing problems. As a result, there exists a need in the art that addresses these problems.

Therefore a primary object of this invention is to provide an adjustable saddle that compensates for intonation deviations due to differing string thicknesses of each individual string.

SUMMARY OF THE INVENTION

An adjustable saddle for a musical instrument has a base with a plurality of depressions that form an interior track surface. Extending from the inner track surface to an indentation on the lower surface of the base is a through-hole. Disposed within the depressions are a plurality of support guide members that are releasably and slidably connected to the base. The guide members have an upper front edge with a front slot and an upper rear edge with a rear slot and the upper rear edge is lower than the upper front edge.

A string extends from the head stock to the front slot and then to the rear slot to form a first break angle. The string then extends from the rear slot to the through-hole, into the indentation, and to a terminal end to form a second break angle.

DETAILED DESCRIPTION OF THE PREFERRED EMBODIMENT

Figure 1:
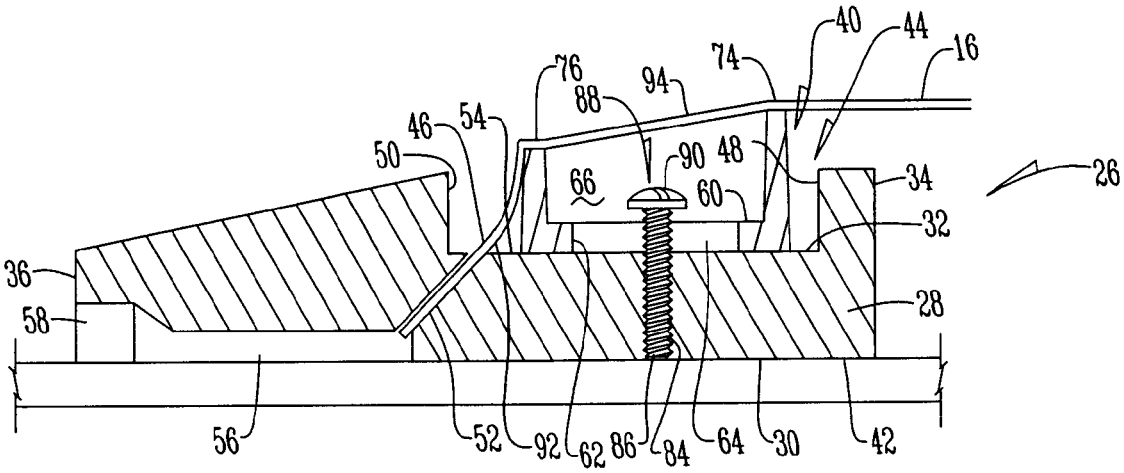
FIG. 1 is a side sectional view of an adjustable saddle.

Referring to the figures, an instrument 10 is provided that has a hollow body 12 and a sound board 14. The instrument 10 includes a plurality of string elements 16 that extend from a first end 18 having a head stock 20 to a second end 22 having a bridge 24. In a preferred embodiment the instrument 10 is an acoustic guitar.

Figure 2:
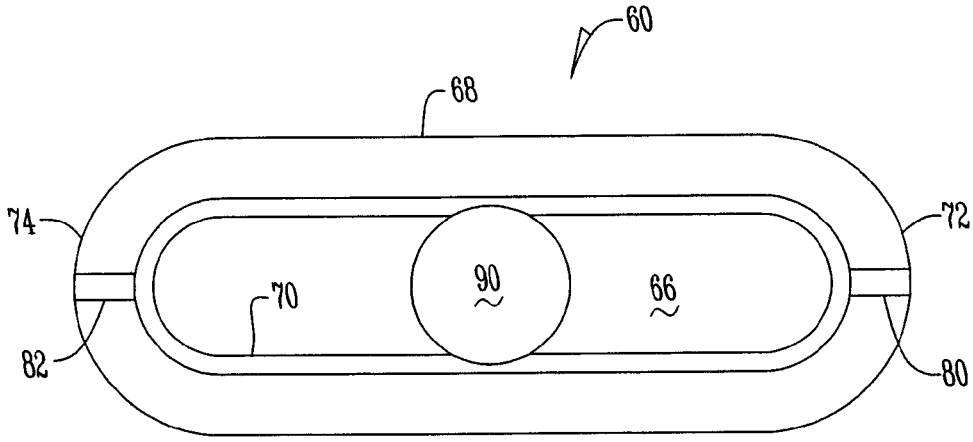
FIG. 2 is a top plan view of a support guide member.
Figure 3:
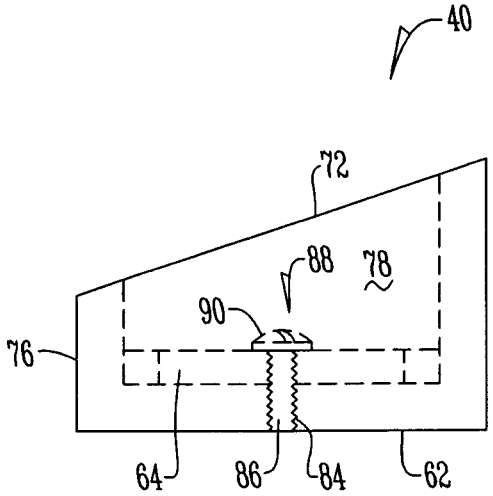
FIG. 3 is a side view of a support guide member.
Figure 4:
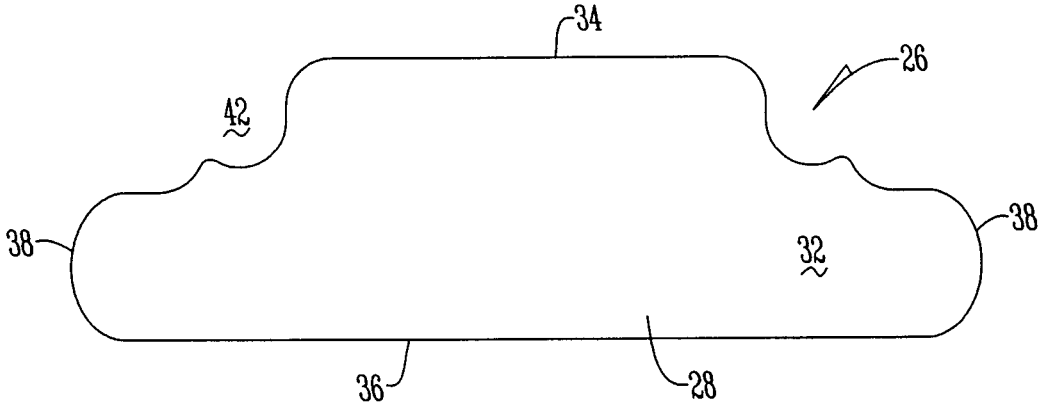
FIG. 4 is a top plan view of an adjustable saddle.
Figure 5:
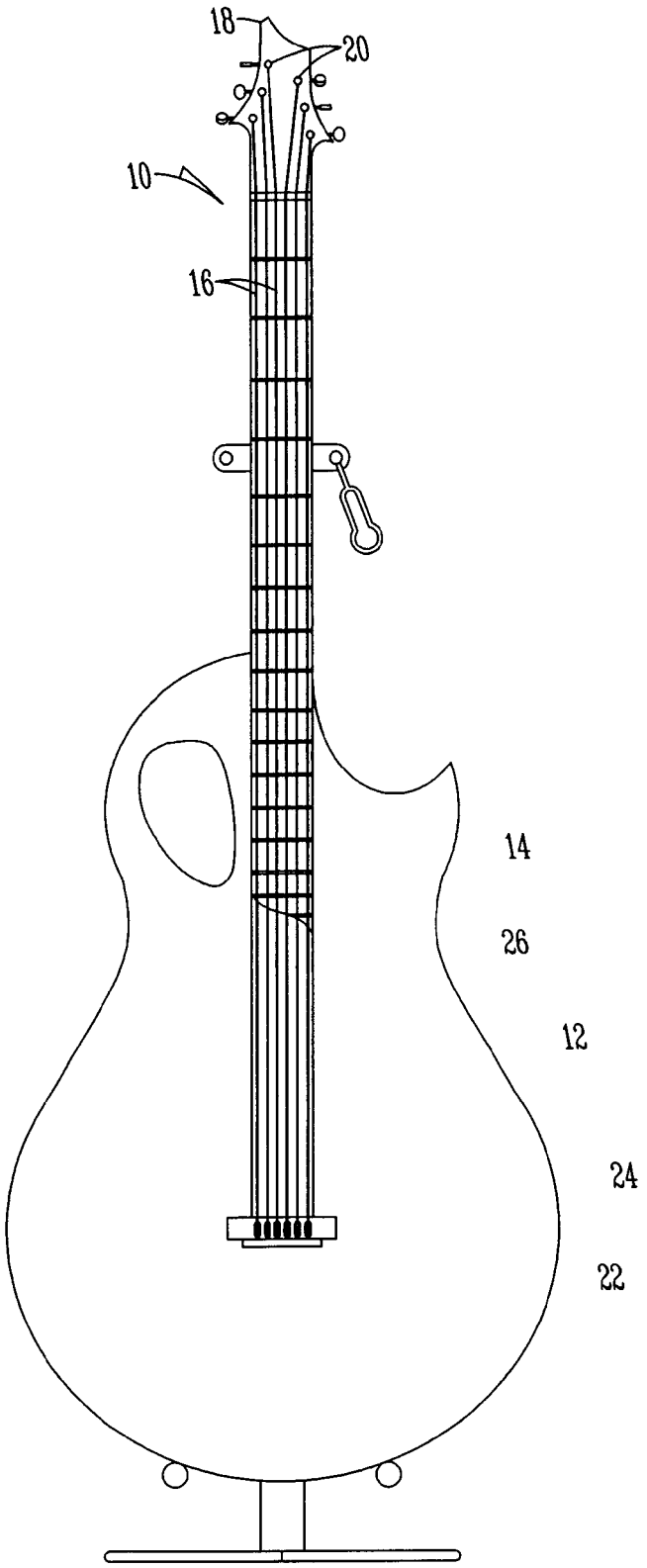
FIG. 5 is a top plan view of an instrument.

The bridge 24 utilizes an adjustable saddle assembly 26 as shown in FIGS. 1 and 2. The adjustable saddle 26 includes a saddle body or base 28 having a lower surface 30, an upper surface 32 with a front edge 34, a rear edge 36, and side edges 38 extending therebetween. In a preferred embodiment, the components of the saddle 26 that interact with the strings 16, and particularly the string suspension and support guide bodies 40 and/or the saddle base 28 are made of wood or bone, and are not made of metal. The lower surface 30 in a preferred embodiment is substantially planar or has any other contour such that the lower surface 30 matches the contour and matingly aligns with an upper surface 42 of the soundboard 14 of the instrument's 10 hollow body 12 or alternatively the bridge 24 of a stringed instrument 10.

Disposed within and extending from the upper surface 32 of the saddle body 28 into an interior of the saddle body 28 are a plurality of longitudinal slots or openings 44. The plurality of longitudinal slots or openings 44 in a preferred embodiment are formed as a plurality of parallel, spaced depressions or tracks 46 forming interior track surfaces below the upper surface of the saddle body having equally spaced lateral widths and center longitudinal axes which align with the strings 16 and the terminal attachment positions of the strings 16 to the body 12 of the instrument. Furthermore, each of the plurality of parallel, spaced depressions or tracks 46 within the upper surface 32 of the saddle body 28 have longitudinal lengths which extend from a first end 48 adjacent to the front edge 34 of the saddle body 28 to a second end 50 proximate to the rear edge 36 of the saddle body 28. In one embodiment, the longitudinal lengths of one or more of the plurality of parallel, spaced depressions or tracks 46 are varied in length based upon the gauge and/or weight/thickness and the corresponding intonation point of the particular string 16 which is positioned above and aligns with the longitudinal center axis of the track.

A through-hole or aperture 52 is provided within each of the plurality of parallel, spaced depressions or tracks 46 wherein the hole 52 extends from the interior track surface 54 to the lower surface 30 of the saddle body 28 adjacent the second or rear end 50 of each of the tracks 46 aligned to intersect with the center longitudinal axis thereof. Each through-hole or aperture 52 extends into an indentation 56 cut into the lower surface 30 of the saddle body 28 from the rear edge 36 thereof to facilitate mounting the terminal ends 58 of the strings 16 to the guitar body 12.

A string suspension and support guide 40 is provided within each of the depressions or tracks 46 of the saddle body 28. Each of the string suspension and support guides 40 includes a body 60 which conforms to the contour and width of the parallel, spaced depressions or tracks 46 but has a longitudinal length which is shorter than that of the depressions or tracks 46 such that each of the string suspension and support guide bodies 40 are slidable to different longitudinal positions within the tracks relative to the front 34 and rear 36 edges of the saddle body 28. Each of the string suspension and support guide bodies 40 includes a lower surface 62 which slidably engages the interior track surface 54 of the depressions or tracks 46 and a central longitudinal slot 64 extending from adjacent a front edge of each of the bodies 60 to a rear edge of each of the bodies 60 and aligned with the center longitudinal axis of each of the tracks 46. Each longitudinal opening 64 extends transversely through the center of each of the bodies 60 from the lower surface 62 of the body 60 to an interior opening 66 surrounded by the outer peripheral edges 68 of the body 60 to provide an interior longitudinal shoulder 70 on each side thereof.

The outer peripheral edges 68 of the suspension and support guide body 40 extend from the lower surface of the body 60 to an upper edge 72 which extends above the upper surface 32 of the saddle body 28 and is defined by an upper front edge 74, an upper rear edge 76 and upper side edges 78. The upper side edges 78 extend laterally and downwardly at an angle from the upper front edge 74 oriented adjacent the front of the saddle body 28 to the upper rear edge 76 oriented adjacent the rear edge 36 of the saddle body 28 such that each body 60 has an angled transverse profile with the upper front edge 72 positioned higher relative to the bottom surface 30 of the saddle body 28 and extending upward from the upper surface 32 of the saddle body 28 at a height greater than that which the upper rear edge 76 extends above the upper surface 32 of the saddle body 28. In one embodiment a front longitudinal slot or indention 80 is formed within and extends downwardly into the upper front edge 72 of each of the bodies 60 and a rear longitudinal slot or indention 82 is formed into the upper rear edge 74. The front and rear longitudinal indentions 80, 82 align with the center longitudinal axes of the tracks 46 and are sized corresponding to the gauge and/or weight/thickness of the particular string 16 which aligns with and is received within the slots or indentions 80, 82.

A centrally located adjustment aperture 84 is provided within each of the plurality of parallel, spaced depressions or tracks 40 wherein the adjustment aperture 80 extends from the interior track surface 54 to the lower surface 30 of the saddle body 28 and is aligned to intersect with the center longitudinal axis of the tracks 40 and opening 66 of the string suspension and support guide body 40. A shaft 86 of an adjustment screw 88 is threadably received within each of the adjustment apertures 84 and disposed through the longitudinal slot 64 of each suspension and support guide bodies 40 such that a head 90 of the adjustment screw 88 engages the interior longitudinal shoulders 70 on each side of the longitudinal slot 64 and retains the support guide body 40 securely within the tracks 46.

In operation, the longitudinal position of each of the support guide bodies 40 is adjusted within the tracks 46 to compensate for intonation deviations due to differing string 16 thicknesses. In order to do so, the adjustment screw 88 is rotated such that the adjustment screw 88 and head 90 thereof are extended upward from the outer peripheral edges 68 and longitudinal slot 64 and the support guide body 60 is slid within the tracks 46 to the appropriate position either toward or away from the front edge 34 of the saddle body 28. Once the proper position is reached, the screw 88 is re-tightened to secure the upper front edge 74 of each of the support guide bodies 40 in the proper longitudinal positions within the tracks 46.

Next, each guitar string 16 is threaded from the terminal mounting position 58 of the guitar body 12 through each of the through holes 52 and is placed over the upper rear 76 and upper front edges 74 of the support guide body 60 such that a portion of the string 16 extending from the notch 82 of the rear upper side edge 76 through the holes and to the terminal mounting position of the guitar body forms a break angle 92. A portion of the string 16 also extends from the notch 80 of the front upper side edge 74 to the rear upper side edge 76 and extends downwardly at an angle from the front upper side edge 74 to the rear upper side edge 74 forms an additional break angle 94 thus forming primary 92 and secondary 94 break angles. Thus, two points of constant pressure are provided to positively influence the manner and stability of how the string 16 interacts with the saddle 26. Furthermore, with the guitar string 16 extending from the front upper side edge 74 of the support guide body 40 to the nut and the support guide body 40 secured in the proper longitudinal position within the track 46 based upon the gauge and/or weight/thickness and the corresponding intonation point of the particular string 16 which is positioned above and aligns with the longitudinal center axis of the track 46 to the nut, the adjustment of the guide bodies within the tracks 46 compensate for intonation deviations due to differing string 16 thicknesses.

Therefore, an adjustable saddle has been disclosed that compensates for intonation deviations due to differing string thicknesses of each individual string, provides for multiple, variable positions of individual saddle members wherein each of which compensated for the downward pressure of each string on each saddle member, and provides variable engagement and adjustability with each guitar string to compensate for differing intonation points of strings having various gauges. Furthermore, the above-disclosed adjustable saddle is removable, can be utilized in multiple instruments, and provides for multiple, variable positions of individual saddle members which each provide two points of constant pressure to provide a primary and secondary break angle. As a result, an adjustable saddle has been disclosed which at the very least meets all of its stated objectives.

It will be appreciated by those skilled in the art that other various modifications could be made to the device without parting from the spirit and scope of this invention. All such modifications and changes fall within the scope of the claims and are intended to be covered thereby.

What is claimed is:

1. An adjustable saddle for a musical instrument comprising:

a base having a plurality of depressions that form an interior track surface;

a plurality of support guides are disposed within the depressions and are slidably connected to the base;

the support guides have an upper front edge with a front slot that is higher in relation to the base then an upper rear edge having a rear slot;

wherein a string is received within the front slot and extends to and is received within the rear slot to form a first break angle; and the string extends from the rear slot to a through-hole in the base to form a second break angle.

2. The saddle of claim 1 wherein the through-hole extends through the base to an indentation in the base that receives a terminal end.

3. The saddle of claim 1 wherein the support guides are slidably secured to the base by a screw that is received within an aperture in the base such that a head of the screw engages an inwardly extending shoulder of the support guide to secure the support guide in position when desired.

* * * * *